US006357520B1

(12) United States Patent
Kato et al.

(10) Patent No.: US 6,357,520 B1
(45) Date of Patent: Mar. 19, 2002

(54) HEAT EXCHANGER

(75) Inventors: Soichi Kato; Muneo Sakurada; Shin Kurihara; Sadao Haiya; Takashi Sugita; Shoji Akiyama; Takahumi Umehara, all of Saitama (JP)

(73) Assignee: Zexel Corporation, Tokyo (JP)

( * ) Notice: Subject to any disclaimer, the term of this patent is extended or adjusted under 35 U.S.C. 154(b) by 0 days.

(21) Appl. No.: 09/486,490

(22) PCT Filed: Aug. 27, 1998

(86) PCT No.: PCT/JP98/03823

§ 371 Date: May 25, 2000

§ 102(e) Date: May 25, 2000

(87) PCT Pub. No.: WO99/11994

PCT Pub. Date: Mar. 11, 1999

(30) Foreign Application Priority Data

Sep. 1, 1997 (JP) ..... 9-236336

(51) Int. Cl.[7] ..... F28D 1/00
(52) U.S. Cl. ..... 165/149; 165/67
(58) Field of Search ..... 165/67, 149

(56) References Cited

FOREIGN PATENT DOCUMENTS

| | | |
|---|---|---|
| JP | 3-87063 | 9/1991 |
| JP | 3-279798 | 12/1991 |
| JP | 4-244596 | 9/1992 |
| JP | 7-120189 | 5/1995 |

*Primary Examiner*—Christopher Atkinson
(74) *Attorney, Agent, or Firm*—Kanesaka & Takeuchi

(57) ABSTRACT

A heat exchanger comprises a plurality of tubes layered with fins intervened between them, header pipes disposed on the end portions of the tubes, and side plates for holding the tube layer, wherein each of the side plates (8) is connected to a side plate insertion hole (10) formed on the header pipe (3) or (4) by inserting its end portion (82) into the side plate insertion hole and forming a taper on the end portion (82) of the side plate (8) to decrease a thickness toward the leading end **(82*a*). The end portions (82) of the side plates (8) are tapered toward the leading ends to decrease a width, contact portions (81*a*) are formed on the side plate to contact with the outer surface of the header pipes (3), (4), and the contact portions are brazed with the outer surface of the header pipe. Further, a stopper means is formed on the end portions of the side plates to prevent the end portions of the side plates from coming out of the side plate insertion holes (10)**.

3 Claims, 9 Drawing Sheets

(b)

(a)

HEAT EXCHANGER

TECHNICAL FIELD

The present invention relates to a heat exchanger which comprises a plurality of tubes layered with fins intervened between them, header pipes disposed on both ends of the tubes, and side plates for holding the tube layer.

BACKGROUND ART

A generally known heat exchanger is configured by stacking a plurality of tubes with fins intervened between them, and connecting to communicate respective end portions of the tubes with header pipes disposed on both sides of the tube layer. According to this configuration, a medium for heat exchanging flows to meander a plurality of times between inlet and outlet joints disposed on the header pipes to make heat exchange with the atmospheric air while flowing.

This type of heat exchanger is improved its structural strength by disposing side plates for holding the tube layer. Specifically, the side plates are connected with the outermost fins of the tube layer, and their end portions are supported by the respective header pipes.

Generally, each member of the tubes, the header pipes, the fins and the side plates is formed of a metallic material clad with a brazing material by shaping into a predetermined form. And the formed members are assembled by means of a jig and the like, the assembly is sent into a furnace and heated so to be brazed into one body. Especially, the side plates are inserted at both end portions into and brazed to the side plate insertion holes formed at the essential portions of the header pipes.

The aforesaid side plate insertion holes are formed to have such a size that the end portions of the side plates are inserted without rattling. Thus, when the end portions of the side plates are inserted into and brazed to the side plate insertion holes, airtightness and watertightness of the header pipes are secured without fail.

Therefore, it is a very troublesome job to insert the end portions of the side plates into the side plate insertion holes, causing lowering of the productivity of the heat exchanger.

Particularly, a taper for increasing an opening area is conventionally formed on the inner periphery of the side plate hole to make it easy to insert the end portion of the side plate. But, such tapering work was very hard because a machine and a tool are obstructed within the side plate holes.

Accordingly, in view of the aforesaid drawbacks, it is an object of the present invention to provide a heat exchanger which can have the side plates assembled with ease.

DISCLOSURE OF THE INVENTION

The invention recited in claim 1 is a heat exchanger comprising a plurality of tubes layered with fins intervened between them, header pipes disposed on the end portions of the tubes, and side plates for holding the tube layer, wherein each of the side plates is connected to a side plate insertion hole formed on the header pipe by inserting its end portion into the side plate insertion hole, and forming a taper on the end portion of the side plate to decrease its thickness toward its leading ends.

Thus, the heat exchanger of the present invention is formed the taper at the end portions of the side plates to decrease the thickness toward the leading ends, so that the end portions of the side plates can be easily inserted into the side plate insertion holes of the header pipes. In other words, when the end portions of the side plates are to be inserted into the side plate insertion holes, they can be guided in position by the tapers even if the positioning is deviated somewhat in the thickness direction.

Therefore, the assembling property of the side plates can be improved, and the productivity of the heat exchanger can also be improved accordingly.

Particularly, the taper for increasing the opening area is conventionally formed on the inner periphery of the side plate insertion hole in order to facilitate the insertion of the end portions of the side plates, but such tapering work is quite difficult because a machine and a tool used are obstructed within the side plate insertion holes. But, the present invention can remedy such a disadvantage because the end portions of the side plates are tapered.

The invention described in claim 2 is the heat exchanger according to claim 1, wherein the end portions of the side plates are tapered toward the leading ends to decrease their width.

Thus, the heat exchanger of the invention is formed the taper at the end portions of the side plates to decrease the width toward the leading ends, so that the end portions of the side plates can be easily inserted into the side plate insertion holes of the header pipes. In other words, when the end portions of the side plates are to be inserted into the side plate insertion holes, they can be guided in position by the tapers even if the positioning is deviated somewhat in the width direction.

Therefore, the assembling property of the side plates can be further improved.

The invention recited in claim 3 is the heat exchanger according to claim 1 or 2, wherein contact portions are formed on the side plate to contact with the outer surface of the header pipe, and the contact portions are brazed with the outer surface of the header pipe.

Thus, the heat exchanger of the invention brazes the contact portions of the side plate to the outer surface of the header pipe, so that the supporting strength of the side plate can be improved, and its structural strength can be improved.

And, when the end portion of the side plate is inserted into the side plate insertion hole, the side plate can be positioned by contacting the contact portions to the outer surface of the header pipe. Therefore, the side plate can be assembled accurately.

The invention recited in claim 4 is the heat exchanger according to claim 3, wherein the header pipe has a round tubular shape, and the contact portions have a curvature to externally fit to the outer surface of the header pipe.

Thus, in the heat exchanger of the invention, the contact portions of the side plate have a curvature to externally fit to the outer surface of the header pipe having a round tubular shape, so that the supporting strength of the side plate can be further improved, and its structural strength can be further improved. In other words, it is effected because the contact and the brazing of the contact portions and the outer surface of the header pipe are made on a 3-D surface having a depth.

And, since the contact portions are externally fitted to the outer surface of the header pipe, they serve as a reinforcing member of the header pipe, and the header pipe can be prevented from being deformed or damaged.

The invention recited in claim 5 is the heat exchanger according to any of claims 1 to 4, wherein a stopper means is formed on the end portions of the side plates to prevent the end portions of the side plates from coming out of the side plate holes.

Thus, since the heat exchanger of the invention has a stopper means to prevent the end portion of the side plate from coming out of the side plate insertion hole, it is possible to prevent the end portion of the side plate from coming out of the side plate insertion hole until the side plate is assembled and brazed. In other words, the side plate can be attached firmly, and the end portion of the side plate can be brazed securely with the side plate insertion hole.

And, after brazing, the supporting strength of the side plate can be increased by the stopper means, and its structural strength can be improved.

BEST MODE FOR CARRYING OUT THE INVENTION

Specific embodiments of the invention will be described in detail with reference to the accompanying drawings.

Figure 1:
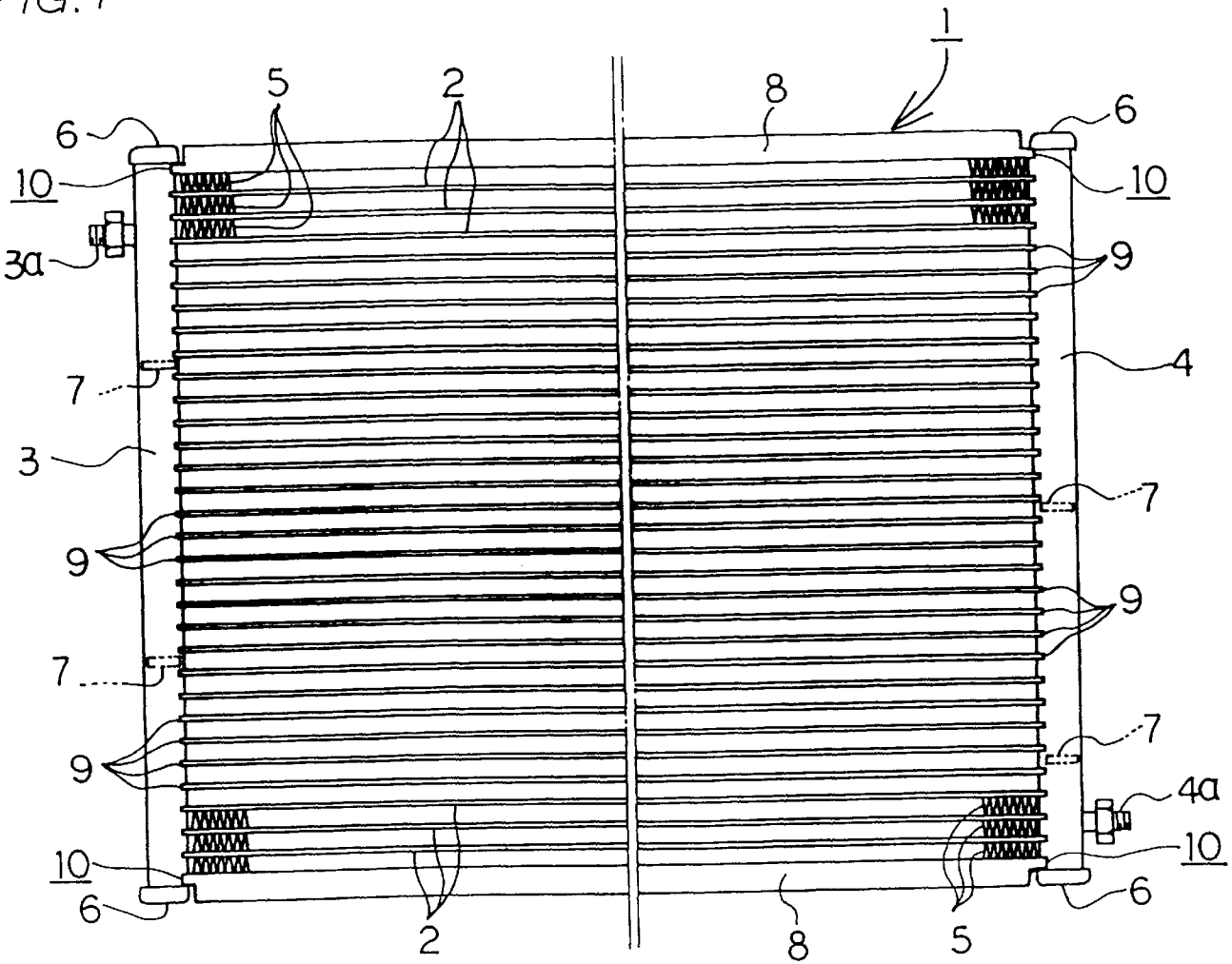
FIG. 1 is a front view showing a heat exchanger according to an embodiment of the present invention.

It is seen in FIG. 1 that a heat exchanger 1 according to the present invention comprises a plurality of tubes 2, 2 layered with fins 5, 5 intervened between them, and header pipes 3, 4 which are disposed at both ends of and communicated with the tubes 2, 2.

The respective header pipes 3, 4 are sealed at their top and bottom end openings by caps 6, 6, divided their interiors by partition plates 7, 7 which are disposed at predetermined positions, and provided with an inlet joint 3*a* for taking in a medium or an outlet joint 4*a* for externally discharging the medium. Tube insertion holes 9, 9 are formed at predetermined intervals on the respective header pipes in the their longitudinal directions. The respective tubes 2, 2 are inserted and brazed their respective ends into the tube insertion holes 9, 9.

And, side plates 8, 8 are disposed on the top and the bottom of a layer of the tubes 2, 2. Each side plate 8 is brazed to the outermost fin of the layer of the tubes 2, 2 and both ends of the side plates 8 are inserted into and brazed to side plate insertion holes 10 formed on the respective header pipes 3, 4 to hold the layer of the tubes 2, 2 and to improve a structural strength of the heat exchanger.

By configuring as described above, a medium taken in through the inlet joint 3*a* is meandered a plurality of times to flow so to travel between the header pipes 3 and 4 in a predetermined group unit of the tubes 2, flowed flown through the tubes 2 while heat-exchanging, and discharged from the outlet joint 4*a*. And, the heat exchange by the medium is promoted by a heat radiation effect of the fins 5 disposed between the tubes 2, 2 and the side plates 8.

The tubes 2, 2, the header pipes 3, 4, the fins 5, 5, the caps 6, 6, the partition plates 7, 7 and the side plates 8, 8 are made by shaping a metallic material having a brazing material clad into predetermined forms, assembled and brazed into one body.

Figure 2:
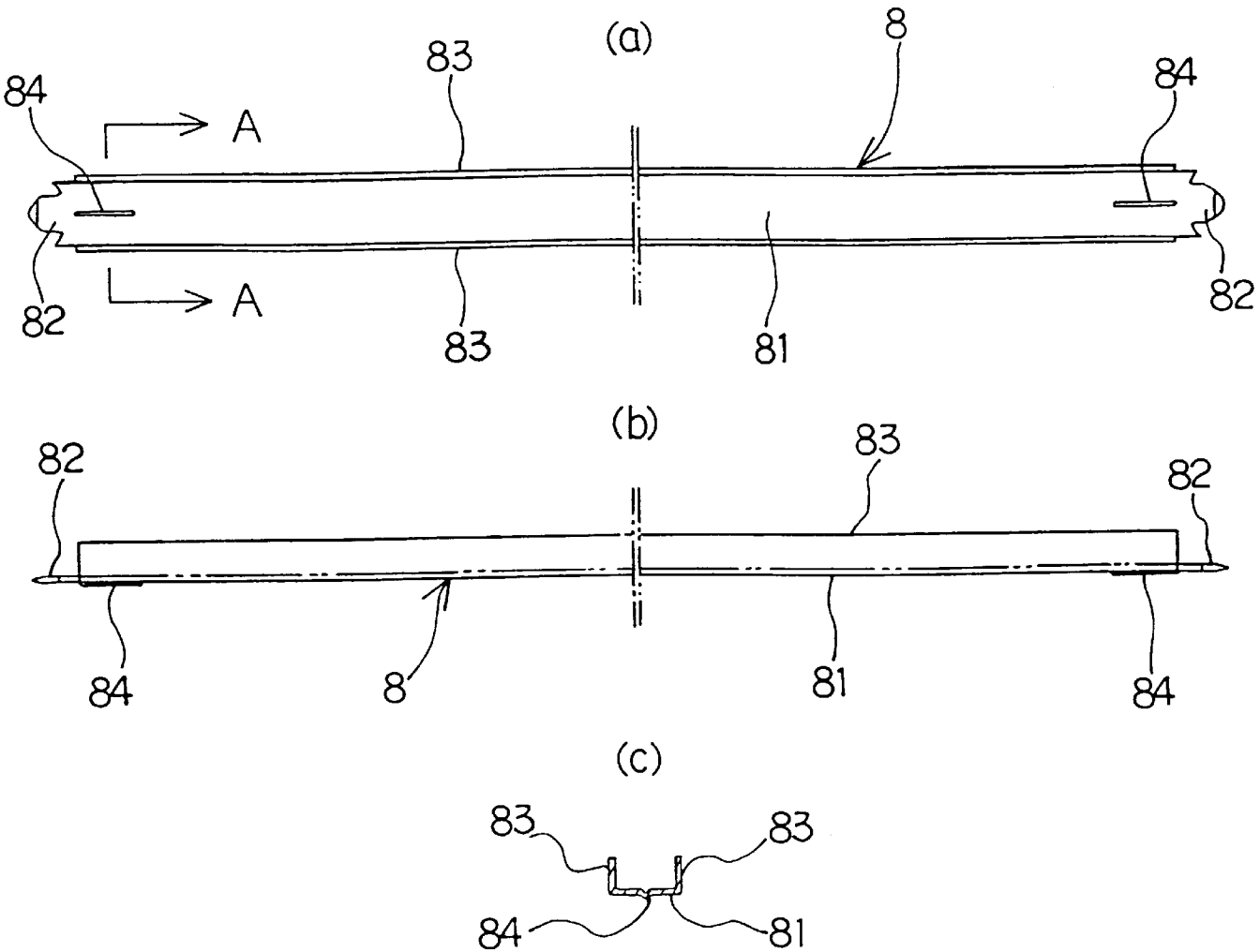
FIG. 2(*a*) is a front view showing a side plate, FIG. 2(*b*) is a side view showing the side view and FIG. 2(*c*) is a sectional view taken along line A—A of FIG. 2(*a*) according to the embodiment of the invention.

As shown in FIG. 2(*a*) to FIG. 2(*c*), the side plate 8 has a plate body 81, end portions 82, 82 formed on both ends of the plate body 81 and walls 83, 83 formed by vertically erecting edges in a cross direction of the plate body 81, so to have substantially a U-shaped cross section in its longitudinal direction. Reference numeral 84 in the drawings is a projection formed to protrude toward the fin 5 to improve rigidity of the side plate 8 and is pressed against the fin 5 to secure a good assembled state.

Figure 3:
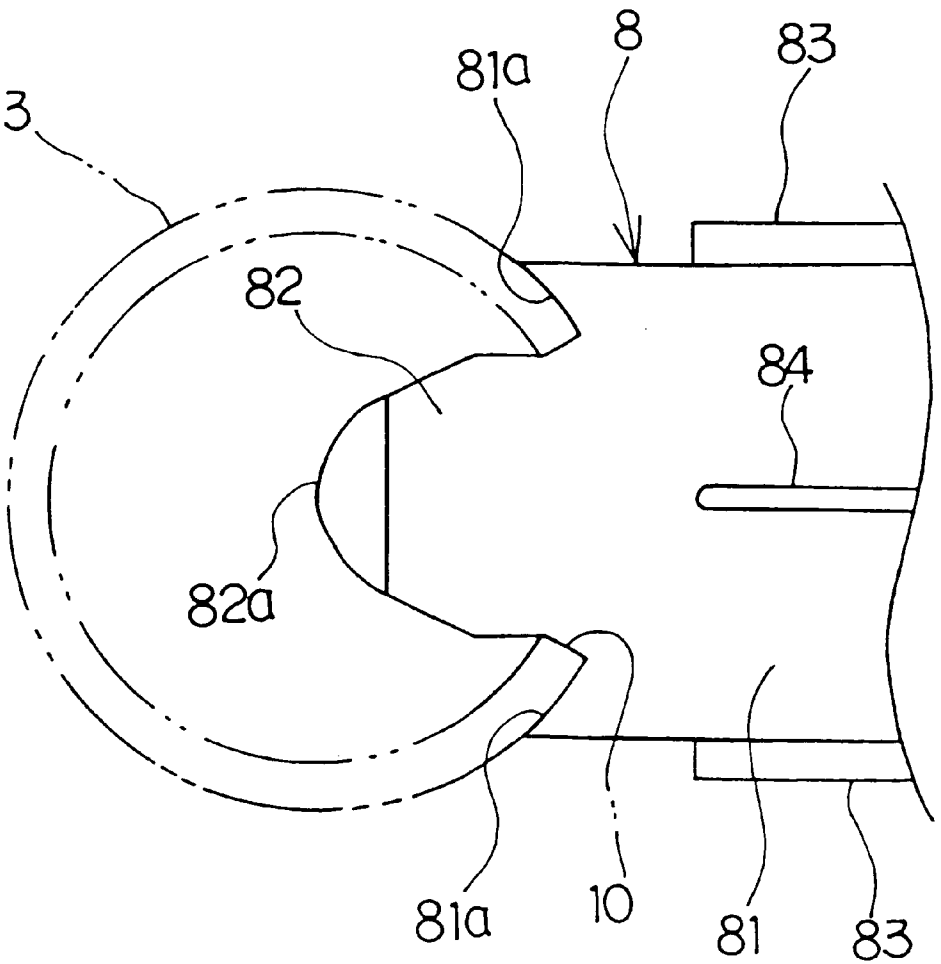
FIG. 3 is a front view showing an end portion of the side plate and a header pipe according to the embodiment of the invention.
Figure 4:
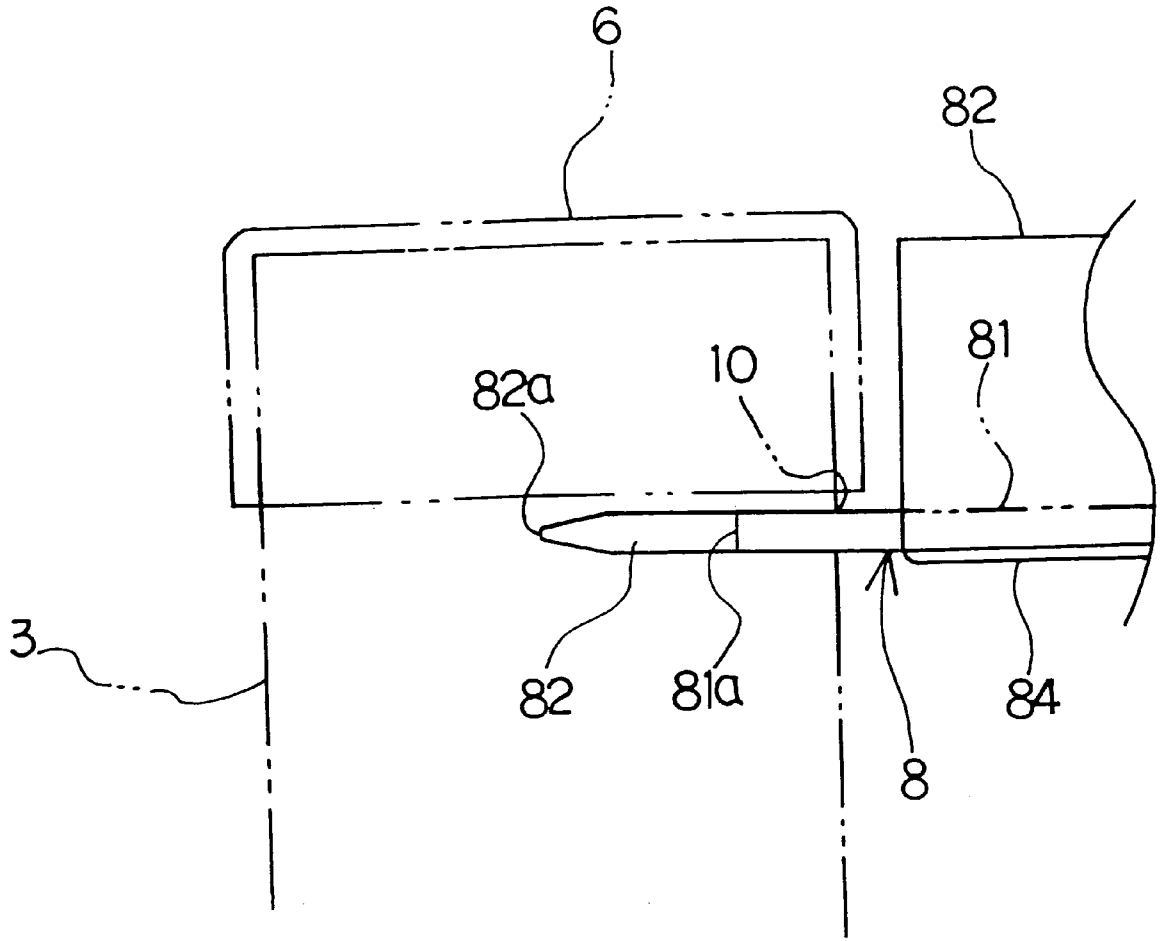
FIG. 4 is a side view showing the end portion of the side plate and the header pipe according to the embodiment of the invention.

As shown in FIG. 3 and FIG. 4, the respective end portions 82, 82 of the side, plate 8 are inserted into and brazed to the side plate insertion holes 10 of the header pipe 3 or 4.

The respective end portions 82, 82 are tapered toward their ends to decrease their thickness and width. In other words, this embodiment forms the tapers to facilitate the insertion of the respective end portions 82, 82 of the side plate 8 inserted into the side plate insertion holes 10, 10 of the header pipe 3 or 4.

Contact portions 81*a*, 81*a* are formed at each edge of the plate body 81 in its longitudinal direction so to come into contact with the outer surface of the header pipe 3 or 4. In other words, the contact portions 81*a*, 81*a* are positioned in the vicinity of the root of the end portion 82 to come into contact with the outer surface of the header pipe 3 or 4 when the end portion 82 is inserted into the side plate insertion hole 10 and brazed with the outer surface of the header pipe 3 or 4.

When the side plate 8 is to be attached, it is placed in position by contacting these contact portions 81, 81 to the header pipes 3, 4.

Figure 5:
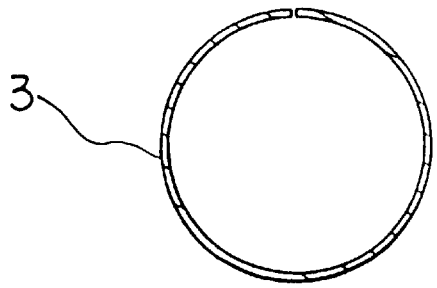
FIG. 5(*a*) is a front view showing the header pipe and FIG. 5 (*b*) is a sectional view taken along line B—B of FIG. 5(*a*) according to the embodiment of the invention.
Figure 5:
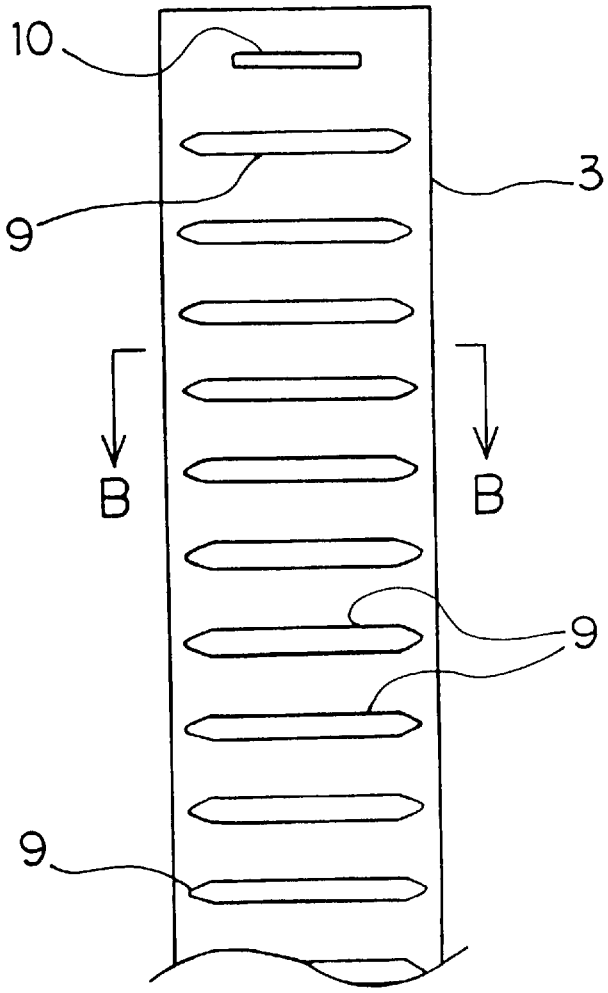

As shown in FIG. 5(*a*) and FIG. 5(*b*), the header pipes 3, 4 of this embodiment have a round tubular shape formed by forming the tube insertion holes 9, 9 and the side plate insertion holes 10, 10 on a plate material and rounding it. The contact portions 81*a*, 81*a* of the side plate 8 have a curvature to externally fit to the outer surface of the header pipe 3 or 4 having the round tubular shape, and their contact and brazing are effected on a 3-D surface having a depth.

Figure 6:
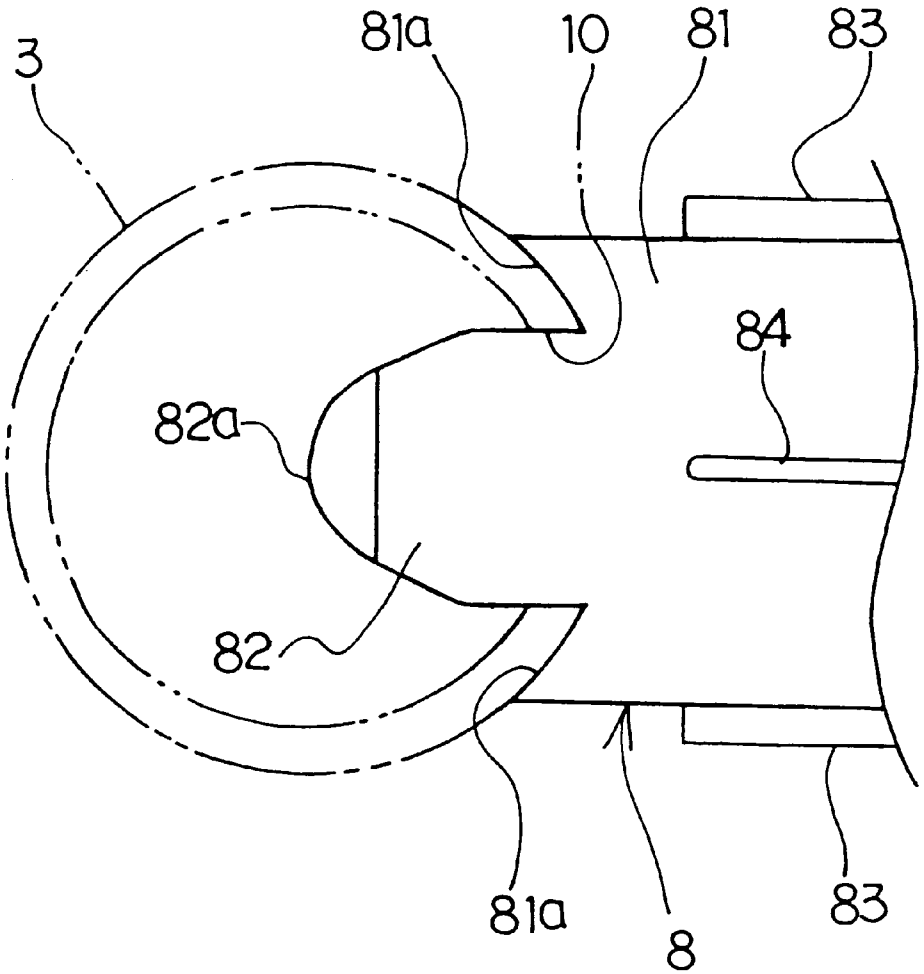
FIG. 6 is a front view showing an end portion of a side plate and a header pipe according to the embodiment of the invention.

As shown in FIG. 6, the edges of the side plate insertion hole 10 in its breadth direction may be cut in a direction parallel to the insertion direction of the end portion 82 of the side plate 8 to increase a brazing area between the edges of the side plate insertion hole 10 in the breadth direction and the end portion 82.

As described above, the heat exchanger of this embodiment is formed the taper at the end portions of the side plate to decrease the thickness toward the leading ends, so that the end portions of the side plate can be easily inserted into the side plate insertion holes of the header pipes. In other words, when the end portions of the side plate is to be inserted into the side plate insertion holes, the side plate can be placed in position by virtue of the taper even if its positioning is deviated in the direction of thickness.

Thus, an assembling property of the side plates can be improved, and productivity of the heat exchanger can be improved.

Conventionally, the inner periphery of the side plate insertion hole is tapered to increase its opening area so that the end portion of the side plate is easily inserted, but the work of forming the taper is very hard because a machine and a tool therefor are obstructed within the side plate hole. But, this embodiment can remedy such a drawback because the taper is formed at the end portions of the side plate.

The heat exchanger of this embodiment has the end portions of the side plate tapered toward the leading ends to decrease the width, so that the end portions of the side plate can be easily inserted into the side plate holes of the header pipe. In other words, when the end portions of the side plate are to be inserted into the side plate holes, the side plate can be placed in position by virtue of the taper even if its positioning is deviated somewhat in the direction of width.

Thus, the assembling property of the side plates can be further improved.

The heat exchanger of this embodiment has the contact portion of the side plate brazed with the outer surface of the header pipe. Therefore, a supporting strength of the side plate can be improved, and its structural strength can be improved.

And, when the end portions of the side plate are to be inserted into the side plate insertion holes, the contact portions are brought into contact with the outer surfaces of the header pipes to enable positioning of the side plate. Therefore, the side plate can be assembled accurately.

In the heat exchanger of this embodiment, the contact portion of the side plate has a curvature to externally fit to the outer surface of the header pipe having the round pipe shape. Therefore, the supporting strength of the side plate can be further improved, and its structural strength can be further improved. In other words, such effects are obtained because the contact and the brazing of the contact portion and the outer surface of the header pipe are effected on the 3-D surface having a depth.

Since the contact portions are externally fitted to the outer surface of the header pipe, they also serve as a reinforcing member for the header pipe, and the header pipe can be prevented from being deformed or broken.

Figure 7:
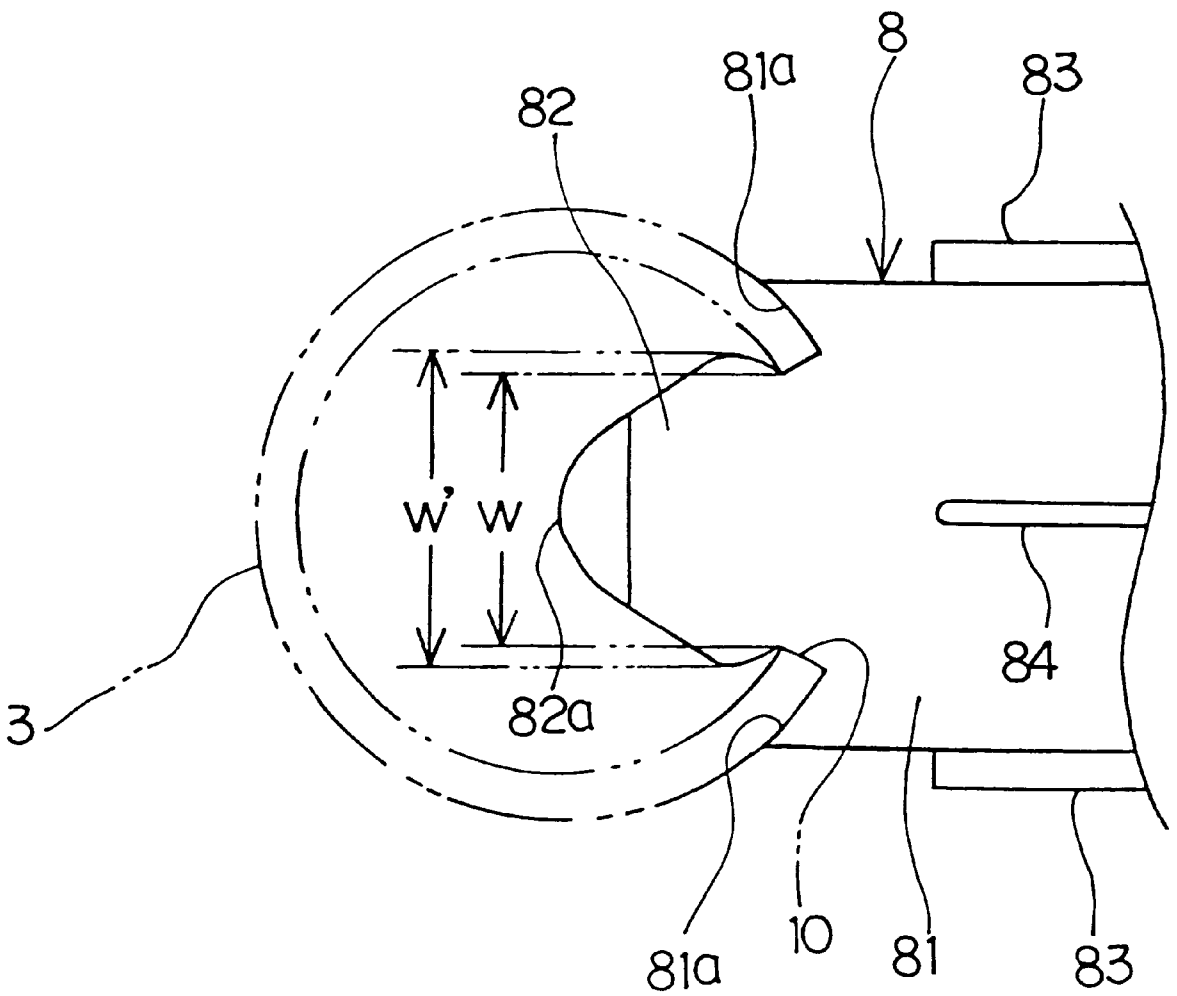
FIG. 7 is a front view showing an end portion of a side plate and a header pipe according to an embodiment of the invention.

Now, another embodiment of the invention will be described with reference to FIG. 7.

This embodiment has a stopper means on the end portion 82 of the side plate 8 to prevent the end portion 82 from coming out of the side plate insertion hole 10. Other structures are the same as in the above embodiment and their descriptions are omitted.

The stopper means of this embodiment is formed by making the end portion 82 of the side plate 8 to have a maximum width w' larger than a width w of the side plate insertion hole 10.

Specifically, the portion of the end portion 82 having the maximum width w' is continuous to the taper which decreases the thickness of the end portion 82 toward its leading end 82*a*. When the end portion 82 of the side plate 8 is inserted into the side plate insertion hole 10 by applying an appropriate pressure, it is positioned within the header pipe 3 or 4. As a result, the portion of the end portion 82 having the maximum width w' is engaged with the inside of the side plate insertion hole 10, so that the end portion 82 is prevented from coming out of the side plate insertion hole 10.

Since the heat exchanger of this embodiment has the stopper means to prevent the end portion of the side plate from coming out of the side plate insertion hole as described above, it is possible to prevent the end portion of the side plate from coming out of the side plate insertion hole until the side plate is assembled and brazed. In other words, the side plate can be attached firmly, and the end portion of the side plate can be brazed securely with the side plate insertion hole.

After brazing, the supporting strength of the side plate can be increased by the stopper means, and its structural strength can be improved.

Another embodiment of the invention will be described with reference to FIG. 8 and FIG. 9.

In this embodiment, the stopper means is provided by bending the end portion 82 of the side plate 8 inserted into the side plate insertion hole 10. Other structures are the same as in the above embodiment and their descriptions will be omitted.

Figure 8:
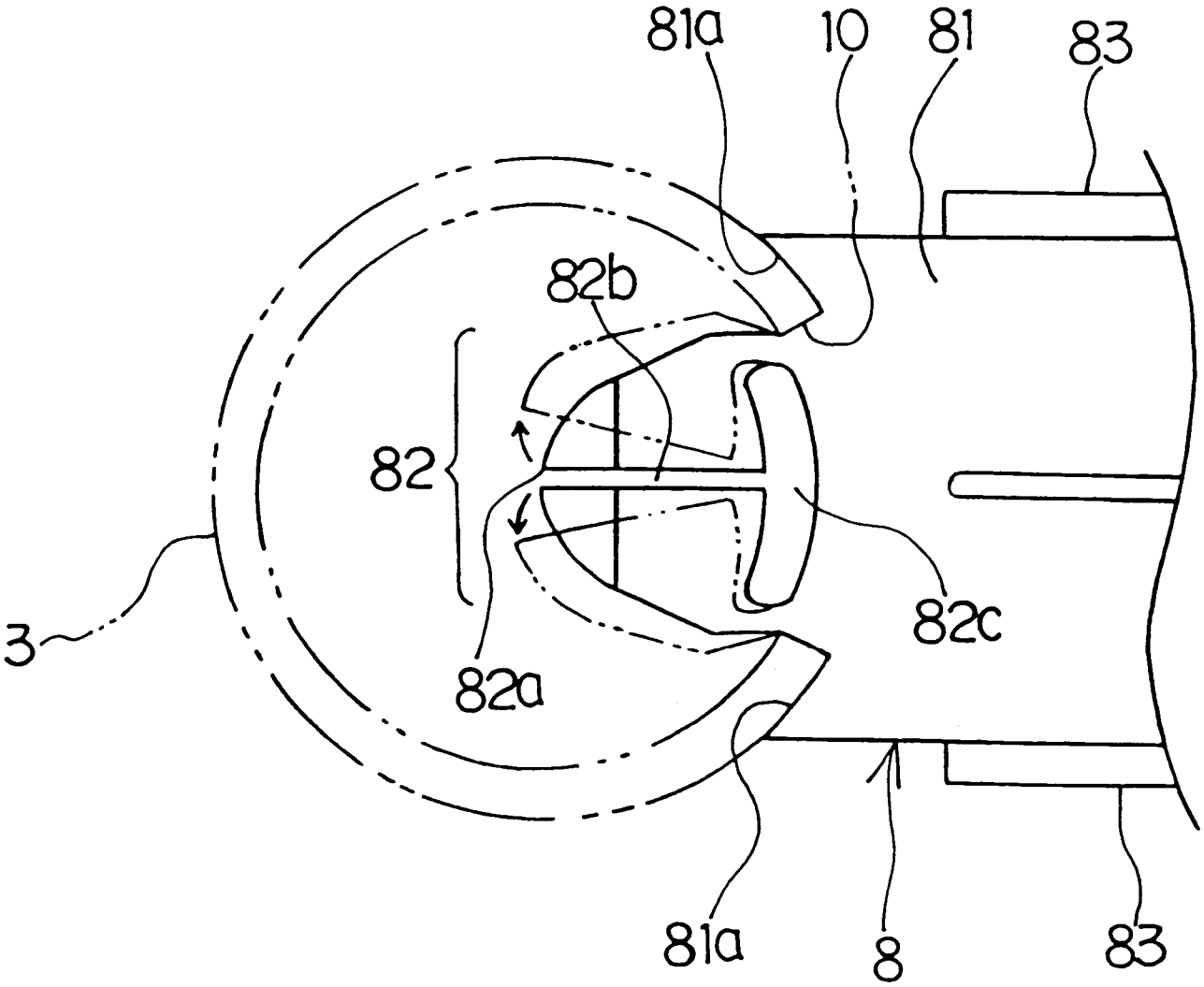
FIG. 8 is a front view showing an end portion of a side plate and a header pipe according to an embodiment of the invention.

Specifically, this embodiment forms a slit 82*b* for dividing the end portion 82 of the side plate 8 in the longitudinal direction and a notch 82*c* continuous from the slit 82*b* as shown in FIG. 8. After inserting the end portion 82 into the side plate insertion hole 10, the end portion 82 is opened in the breadth direction along the slit 82*b* and the notch 82*c* as indicated by arrows and chain lines in the drawing, thereby preventing the end portion 82 from coming out of the side plate insertion hole 10.

Thus, the stopper means can be formed by bending the end portion inserted into the side plate insertion hole. And, the end portion of the side plate can be bent in the respective directions by forming the appropriate slit and notch.

Figure 9:
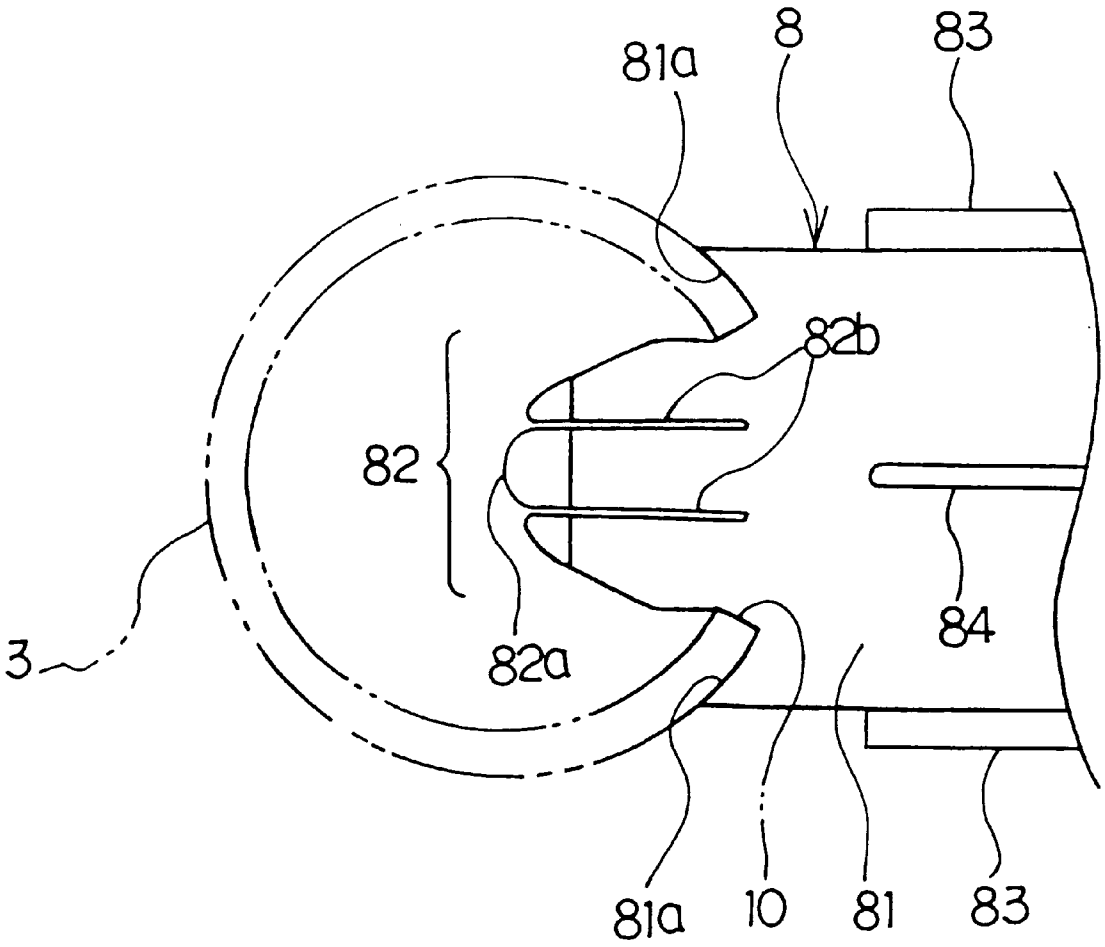
FIG. 9 is a front view showing an end portion of a side plate and a header pipe according to an embodiment of the invention.

As shown in FIG. 9, a plurality of slits 82*b* or notches 82*a* may be formed. The end portion 82 shown in this drawing has the respective portions separated by the slits 82*b* hit by means of a tool so to bend in the up and down directions of the header pipe 3 or 4.

INDUSTRIAL APPLICABILITY

The present invention is a heat exchanger which can improve an assembling property of side plates and improve productivity accordingly and which is suitable for an automobile refrigerating cycle requiring a relatively severe pressure resistance.

What is claimed is:

1. A heat exchanger comprising:

a plurality of tubes;

a plurality of fins layered with and sandwiched between said tubes;

a pair of header pipes of a round tubular shape disposed on opposite ends of said tubes and having side plate insertion holes; and a pair of side plates disposed upper and lower side of said tubes for holding said tubes, each of said side plates having at least one contact portion having such a curvature as to be in close contact with an outer peripheral surface of said header pipes.

2. The heat exchanger according to claim 1, wherein said header pipes are made by rounding a plate material with said side plate insertion holes, and each of said side plate has end portions tapered to decrease a width thereof toward a leading end so as to be easily inserted into said side plate insertion holes and brought into close contact with edges of said side plate insertion holes in a width direction thereof.

3. The heat exchanger according to claim 1, wherein each of said side plate has end portions tapered to decrease a thickness thereof so as to be easily inserted in to said side plate insertion holes.

* * * * *